US005188359A

United States Patent [19]

Wu

[11] Patent Number: 5,188,359

[45] Date of Patent: Feb. 23, 1993

[54] DRUM BEAT SOUNDING RACKET

[76] Inventor: Chui-Li Wu, No. 22, Lane 1046, Sec. 1, Kuo-Chi Road, Tao Yuan City, Taiwan

[21] Appl. No.: 865,103

[22] Filed: Apr. 8, 1992

[51] Int. Cl.[5] ..... A63B 59/18

[52] U.S. Cl. ..... 273/67 R; 273/73 C

[58] Field of Search ..... 273/67, 73, 30; 84/418

[56] References Cited

U.S. PATENT DOCUMENTS

| | | | |
|---|---|---|---|
| 3,048,399 | 8/1962 | Breitbach | 273/67 R |
| 4,330,124 | 5/1982 | Vettorello | 84/418 |
| 4,836,543 | 6/1989 | Holzer | 273/73 C |
| 4,891,175 | 1/1990 | Haines | 273/73 C |

FOREIGN PATENT DOCUMENTS

| | | | |
|---|---|---|---|
| 282936 | 2/1966 | Australia | 273/67 B |
| 3817464 | 11/1989 | Fed. Rep. of Germany | 273/73 C |

*Primary Examiner*—Mark Graham

*Attorney, Agent, or Firm*—Pro-Techtor International

[57] ABSTRACT

Articles of play comprising a racket having a handle portion and a hitting portion integrally formed together, the hitting portion including a hollow annular frame body and a hitting surface which is firmly secured in and highly tensioned by the hollow annular frame body so that a high tension hitting surface with a resonating sound box inside the hollow annular frame body and the handle portion is thus formed when a ball member is hit by the tension hitting surface, a sound like the durm beat is produced.

5 Claims, 3 Drawing Sheets

DRUM BEAT SOUNDING RACKET

BACKGROUND OF THE INVENTION

1. Field of the Invention

The present invention relates to an article of play, and particularly to articles of play for use in the game of hit with a sound like drum beat.

2. Description of the Prior Art

One type of article of play is disclosed in the U.S. Pat. No. 4,995,617 to Miryoung Lee, filed on Mar. 8, 1990, entitled "ARTICLES OF PLAY FOR USE IN THE GAME OF CATCH". The articles can be used in the game of catch only and can not be used in the game of hit. However, another type of article of play is disclosed in U.S. Pat. No. 5,080,374 to Chien P. Yu, filed on Jul. 26, 1991, entitled "ARTICLES OF PLAY FOR USE IN THE GAME OF HIT AND CATCH". The articles can be used in game of both hit and catch, but can not produce any sound when it is used in the game of hit.

SUMMARY OF THE INVENTION

The primary object of the present invention is to provide an article of play which can be used in the game of hit with a sound like the drum beat to make a ball game more fun for the players.

In accordance with one aspect of the invention, there is provided articles of play including a racket having a handle portion and a hitting portion integrally formed together, the hitting portion including a hollow annular frame body and a hitting surface secured in and tensioned by the hollow annular frame body, the frame body having a male frame member with a substantially semicircular cross-section which is provided with a plurality of insert pins located substantially at the central portion thereof spaced at equal intervals and a female frame member with substantially semicircular cross-section which is provided with a plurality of insert holes located at a central portion thereof corresponding to said insert pins of the male frame member, whereby the racket can be assembled in such a manner that the hitting surface is disposed with a plurality of peripheral fixing holes corresponding to the insert pins of the male frame member and is firmly clamped by both of inner peripheral annular portions of said male and female frame members when they are associated together, and thus a high tension hitting surface with resonating sound box inside the hollow annular frame body and the handle portion is thus formed so that when a ball member is hit by the tension hitting surface of the racket, a sound like the drum beat is emitted.

Another objective of this invention is to provide the above article of play, wherein the high tension hitting surface is made of plastic fabric or drumhead material so that when using the racket to hit a ball member, a drum beat-like sound is emitted to make the ball game more interesting.

Further objective and advantages of the present invention will become apparent from a carful reading of detailed description provided hereinbelow, with appropriate reference to the accompanying drawings.

DETAILED DESCRIPTION OF THE PREFERRED EMBODIMENT

Figure 1:
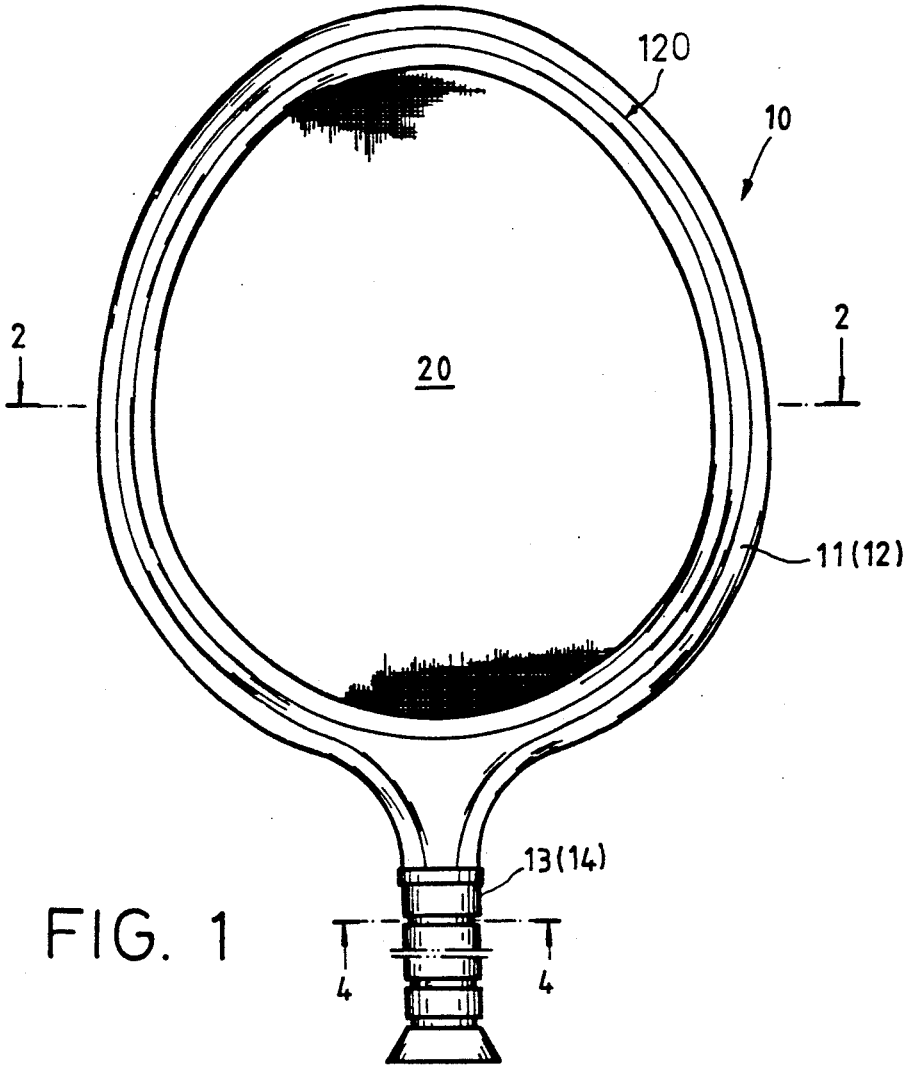
FIG. 1 is a front view of this invention.
Figure 2:
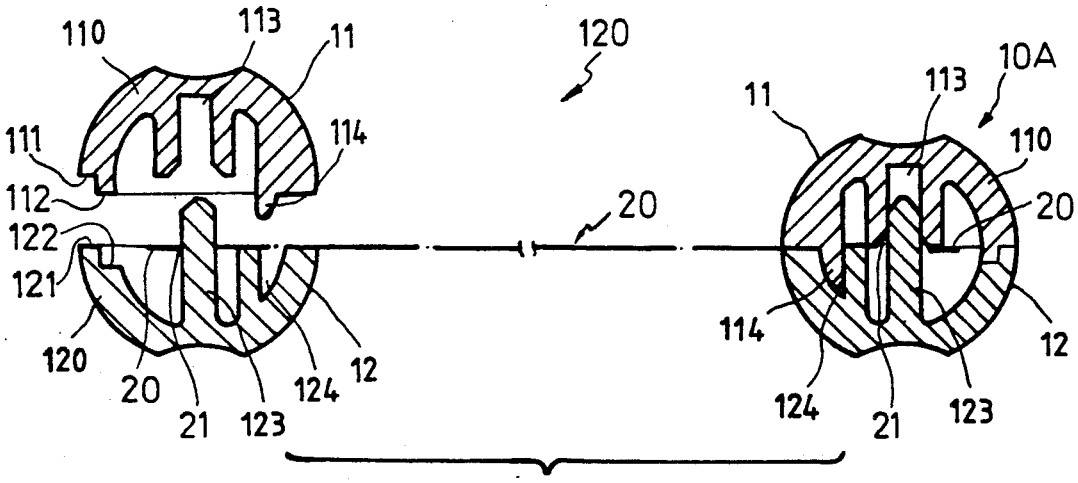
FIG. 2 shows sectional views taken on line 2—2 of FIG. 1, wherein the left half of the frame is an exploded view illustrating that the hitting surface is secured to the frame member.

Please first refer to FIGS. 1 and 2 which show one preferred embodiment of this invention. The racket frame 10 of this invention is substantially oval-shaped comprising a handle portion 13 and a hitting portion 120 integrally formed together. The hitting portion 120 includes a hollow annular frame body 10A and a tension hitting surface 20. The tension hitting surface 20 can be a well resilient artificial fibrous fabric such as knitting fabric, plastic fabric or drumhead material, etc. It can be seen from FIG. 2 that the peripheral size of the tension hitting surface 20 is larger than the center-to-center size of the frame 10 but smaller than the actual size of the frame 10. Multiple fixing holes 21 are formed along the periphery of the hitting surface 20. The center connecting lines of these holes 21 fall within the center line of the frame 10. These holes 21 are distributed along the periphery of the hitting surface 20 at equal intervals. Preferably, at least eight fixing holes 21 are disposed so as to sufficiently evenly share the flatness of the hitting surface 20. As shown in FIG. 2, the frame 10 is composed of a female member 11 and a male member 12 secured thereto, wherein the female member 11 has a semicircular cross-section and the outer side of the female member 11 is formed with a shoulder 111 and a projection 112 from outside to inside. The inner central portion of the female member 11 is formed with multiple equally spaced insert holes 113. Correspondingly, the male member 12 also has a semicircular cross-section and the outer side of the male member 12 is formed with a projection 121 and a shoulder 122 from outside to inside. The inner central portion of the male member 12 is formed with multiple equally spaced insert pins 123 corresponding to the insert holes 113 of the female member 11. When said insert pins 123 of said male frame member 12 is correspondingly inserted into said fixing holes 21 of said hitting surface 20 and the insert holes 113 of said female member 11, the peripheral portion of said hitting surface 20 will be firmly clamped by both of the inner peripheral annular portions of said female male frame members 11 and 12. Thus, the hitting surface 20 with a desired tension and a resonating sound box inside said hollow annular frame body 10 and said handle portion 13 is thus formed.

In order to increase the tension applied on the hitting surface 20, according to the present invention, another embodiment of the frame body 10 is made in such a manner that between the insert holes 113 and the inner periphery of the female member 11, along the inner periphery thereof, an inward extending annular protrusion 114 is formed on the female member 11 and between the insert pins 123 and the inner periphery of the male member 12, along the inner periphery thereof, an inward extending annular groove 124 is also formed on the male member 12, whereby when the male member 12 is secured to the female member 11, the insert pins 123 of the male member 12 are inserted into the insert holes 113 of the female member 11 and the annular protrusion 114 of the female member 11 is fitted into the annular groove 124 of the male member 12. Therefore, when mounting the hitting surface 20, the fixing holes 21 thereof are first fitted to the insert pins 123 and the hitting surface 20 is totally laid over the male member 12 of the frame 10. As shown in FIG. 2, the size of the hitting surface 20 is smaller than the size of the outer periphery of the frame 10. Then the female member 11 is laid over the male member 12 and the annular protrusion 114 thereof extrudes the outer peripheral portion of the hitting surface 20 into the annular groove 124 of the male member 12. Because the groove 124 has a considerable depth, when the female member 11 is fitted with the male member 12, a considerable length of hitting surface 20 is secured into the groove 124 so that the hitting surface 20 is thereby highly tensioned and the male and female members 12, 11 of the frame 10 are firmly associated together. Such assembly has a simple structure and can be assembled quickly and conveniently. In addition, when assembled, the hitting surface 20 is effectively and highly tensioned.

It should be noted that the bonding of the male frame member and the female frame member may just as readily be accomplished by providing the male frame member with at least one an annular protrusion and the female frame member with at least one an annular groove.

Figure 3:
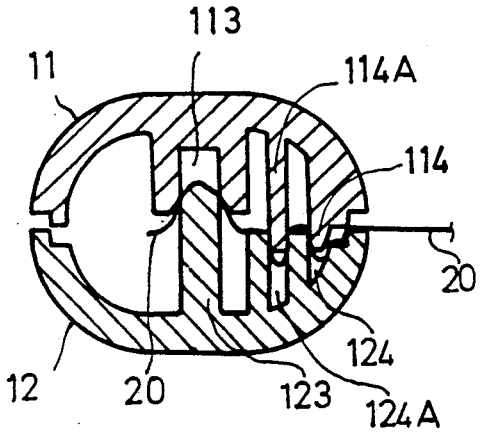
FIG. 3 is a sectional view of another embodiment of the racket frame of this invention.
Figure 4:
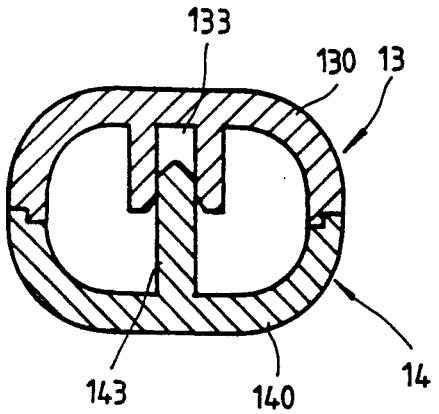
FIG. 4 is a sectional view taken on line 4—4 of FIG. 1.

Referring to FIG. 3, for achieving a more reliable securing effect of the frame 10, besides the first annular protrusion 114 of the female member 11, a second annular protrusion 114A is additionally formed on the female member 11, and a second additional annular groove 124A is also formed on the male member 12. As a result, a further high tension hitting surface 20 secured in the frame 10 can hardly become loosened or detached.

Figure 5:
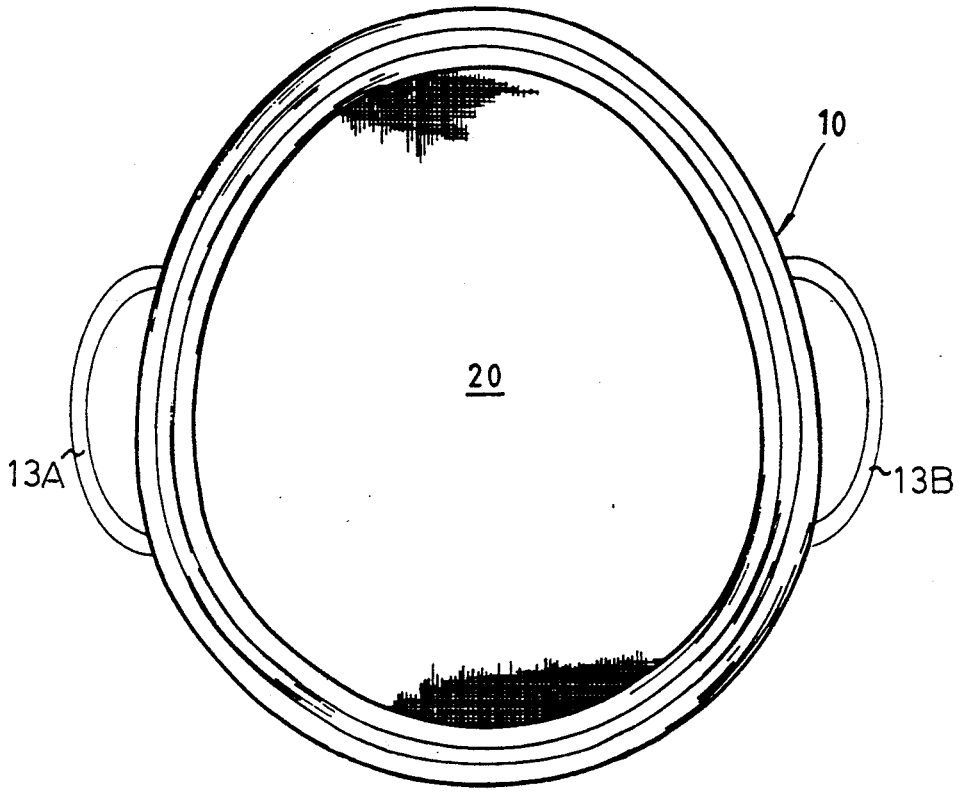
FIG. 5 shows another embodiment of the handle of the hitting portion of this invention.

Furthermore, as shown in FIG. 1, a handle 13 is disposed right under the racket for a single hand to grip. Alternatively, as shown in FIG. 5, two handles 13A, 13B can be disposed on two sides of the racket for both hands to grip. Such both hand use is helpful to the exercise of the shoulders, neck and arms of the player.

It should be noted that since the high tension hitting face 20 of this invention is made of plastic fabric or drumhead material and, since the fabric or drumhead material is highly tensioned and firmly clamped by the frame 10, and the frame 10 is a hollow annular body forming a close sound box, when a ball member (which can be any object having suitable weights and shapes) is hit by the racket, a sound like the drum beat is emitted. This will make the game of hit much more interesting to the players.

It should be also noted that in case the tolerance between the insert holes of the female member and the insert pins of the male member is increased or changed due to the alteration of the material properties and processing conditions during the molding procedure, the male and female members can be nevertheless assembled and then be thermally sealed and melted into an integrated member by a high frequency thermal wave welding machine without needing to use any screw for securing.

What is claimed is:

1. An article of play comprising a racket including a handle portion and a hitting portion integrally formed together, said hitting portion including a hollow annular frame body and a hitting surface firmly secured in and highly tensioned by said hollow annular frame body, said frame body comprised of a male frame member and a female frame member secured thereto, said male frame member having a substantially semicircular cross-section and having a plurality of insert pins located substantially at the central portion thereof, said female frame member also having a substantially semicircular cross-section and having a plurality of insert holes located at a central portion thereof corresponding to said insert pins of said male frame member, said hitting surface having a plurality of fixing holes at the peripheral portion thereof corresponding to said insert pins of said male member; and wherein between said insert holes and an inner periphery of said female frame member, at least one inward extending annular protrusion is formed on said female member, and at least one annular groove is formed along an inner periphery of said male frame member corresponding to said annular protrusion of said female member; wherein said hitting surface is laid over said male frame member with said fixing holes fitted over said insert pins, said female frame member being secured to said male frame member by means of said at least one annular protrusion of said female frame member fitting into said at least one said annular groove of said male frame member, so that said hitting surface is evenly clamped and highly tensioned by and firmly secured in said hollow annular frame body, forming a highly tensioned said hitting surface.

2. The article of play as claimed in claim 1 wherein: said hitting surface is made of a stretchable fabric.

3. The article of play as claimed in claim 1 wherein: said hitting surface is made from drumhead material.

4. The article of play as claimed in claim 1 wherein: said male and female frame members are firmly joined together by means of a high frequency thermal wave weld.

5. An article of play comprising a racket including a handle portion and a hitting portion integrally formed together, said hitting portion including a hollow annular frame body and a hitting surface firmly secured in and highly tensioned by said hollow annular frame body, said frame body comprised of a male frame member and a female frame member secured thereto, said male frame member having a substantially semicircular cross-section and having a plurality of insert pins located substantially at the central portion thereof, said female frame member also having a substantially semicircular cross-section and having a plurality of insert holes located at a central portion thereof corresponding to said insert pins of said male frame member, said hitting surface having a plurality of fixing holes at the peripheral portion thereof corresponding to said insert pins of said male member; and wherein between said insert holes and an inner periphery of said female frame member at least one annular groove is formed on said female member and at least one inward extending annular protrusion is formed along an inner periphery of said male frame member corresponding to said annular groove of said female member;

wherein said hitting surface is laid over said male frame member with said fixing holes fitted over said insert pins, said female frame member being secured to said male frame member by means of said at least one annular protrusion of said male frame member fitting into said at least one said annular groove of said female frame member so that said hitting surface is evenly clamped and highly tensioned by and firmly secured in said hollow annular frame body, forming a highly tensioned hitting surface.

* * * * *